US005362433A

United States Patent [19]

Toscan et al.

[11] Patent Number: 5,362,433

[45] Date of Patent: Nov. 8, 1994

[54] PROCESS OF MAKING POLYURETHANE ELASTOMER THREAD

[75] Inventors: Maria Toscan, Dietwil; Rémy Humbrecht, Littau, both of Switzerland

[73] Assignee: Viscosuisse S.A., Emmenbrucke, Switzerland

[21] Appl. No.: 144,217

[22] Filed: Oct. 28, 1993

Related U.S. Application Data

[63] Continuation of Ser. No. 571,025, Aug. 22, 1990, abandoned, which is a continuation of Ser. No. 246,295, Sep. 9, 1988, abandoned.

[30] Foreign Application Priority Data

Dec. 17, 1986 [CH] Switzerland ..... 5011/86-0

[51] Int. Cl.[5] ..... D01D 5/092; D01D 5/16; D01F 6/70

[52] U.S. Cl. ..... 264/210.8; 264/211.14; 264/290.5; 528/76; 528/80; 528/83

[58] Field of Search ..... 264/205, 210.8, 211.14, 264/235.6, 290.5; 528/76, 80, 83, 85

[56] References Cited

U.S. PATENT DOCUMENTS

| | | | |
|---|---|---|---|
| 3,536,803 | 10/1970 | Epstein et al. | 264/210.5 |
| 3,663,677 | 5/1972 | Keuchel | 264/210.4 |
| 3,679,633 | 7/1972 | Matsubayashi et al. | 528/85 |
| 3,686,387 | 8/1972 | Keberle et al. | 264/184 |
| 4,751,139 | 6/1988 | Hensel et al. | 428/323 |

FOREIGN PATENT DOCUMENTS

| | | | |
|---|---|---|---|
| 2204470 | 8/1973 | Germany . | |
| 2264760 | 1/1975 | Germany . | |
| 1159623 | 7/1969 | United Kingdom | 264/205 |
| 1201433 | 8/1970 | United Kingdom | 264/205 |
| 1245311 | 9/1971 | United Kingdom . | |
| 1339813 | 12/1973 | United Kingdom . | |
| 1393803 | 5/1975 | United Kingdom . | |

*Primary Examiner*—Leo B. Tentoni
*Attorney, Agent, or Firm*—Felfe & Lynch

[57] ABSTRACT

In a process for producing melt-spun elastomer threads with a high modulus, a breaking elongation of 80 to 300% and a boiling shrinkage of at least 20%, multifilament elastic threads are obtained by spin-drawing. A molten mass of polyurethane granulate is simultaneously drawn at a drawing factor of at least 1.5 and wound on spools at 600 m/min. or more. The spun-drawn, non-adhesive TPU thread can be processed to form a flat structure, the elasticity of which can be regulated by setting or by tempering in hot water. The thread can also be tempered before being processed in order to acquire the desired elastic properties.

1 Claim, 2 Drawing Sheets

PROCESS OF MAKING POLYURETHANE ELASTOMER THREAD

This is a continuation of copending application Ser. No. 07/571,025, filed Aug. 22, 1990, now abandoned; which is a continuation of Ser. No. 07/246,295, filed Sep. 9, 1988, now abandoned.

FIELD OF THE INVENTION

The present invention relates to a process for the production of a smooth, melt-spun, multifilament elastomer thread from polyurethanes, as well as to the elastomer thread produced by this process, and the use thereof.

BACKGROUND OF THE INVENTION AND THE PRIOR ART

The manufacture of melt-spun elastomeric polyurethane threads which consist of at least 85 weight percent of segmented polyurethanes is known. Such threads, however, were practically useless because of the tackiness after spinning. A solution of this problem was achieved by a chemical alteration of the polyurethane.

Such a process, in which the tackiness of extruded endless threads was reduced by chemical means, is known (DE-A-22 04 470).

In this known process, polyimides are built into the polymer chain or are added to the polymer melt. The endless threads produced with the polymer thus obtained must be wound on spools at very low speeds, and must then be stretched in a second operation. No information is given about the properties of the threads thus obtained.

Disregarding the fact that the addition of additives produces a reduction of the molecular weight which at the same time brings about a decrease in the melt viscosity, which in turn adversely influences the elastic properties, the tear enlongation and the strength of a resulting yarn, a productivity achieved with full winding speeds of about 160 m/min is inadequate and uneconomical.

From DE-A-19 44 507 a multi--step process is known which reduces the tackiness of elastomeric polyurethane threads in the spinning process. In this process the material is melt-extruded in a first step, the thread thus obtained is strengthened by quenching, and in a second step it is stretched by at least 30%, and in a further step it is relaxed by at least 50% prior to winding on the spool. In a theoretical discussion it is stated that in the case of a small relaxation ratio, that is, at a more accelerated spool winding speed, the tackiness of the thread increases.

In accordance with that process the melt-spun thread is stretched and subsequently again relaxed. The course of this process suggests that the finished, completely cooled elastomer thread is already present on the take off spool. This thread shows the typical properties of polyurethane elastomers; it can no longer be stretched in the strictest sense, but based on its high elasticity it can be strongly deformed, where this deformation is reversible. The deformation process in accordance with DE-A-1944 507 has no great effect on the properties of the thread.

All attempts to manufacture elastomeric polyurethane threads under economical conditions, that is, at higher spinning speeds by spinning from a melt, have heretofore failed because the extruded filaments stick together as soon as the spinning speed is increased above a certain value.

OBJECTS OF THE INVENTION

It is an object of the present invention economically to produce a high-module, high-strength multifilament elastic thread, whose fibrills are not stuck together among themselves, by melt-spinning.

Other objects and advantages of the invention will become apparent as the description thereof proceeds.

DESCRIPTION OF THE INVENTION

The above object is achieved according to the present invention by melt-spinning the polyurethane, simultaneously irreversibly stretching it, and directly winding it on a spool at a rate of at least 600 m/min.

Contrary to this general teaching, it has now surprisingly been found that the known tackiness of the threads toward each other and the fibrills among themselves can be avoided and that a high-module and better processable thread can be produced if the polymer and the stretching conditions are selected so that an irreversible stretching occurs, and if a strain release/relaxation is entirely omitted, and finally if the draw-off speed is additionally increased.

Quenching of the threads after melt-spinning represents an additional expensive process step and produces different properties of the thread.

By virtue of the high spool-winding speeds at high spinning temperatures the economy can be substantially improved. At the same time, threads with very fine fibrills can be produced.

Polyurethanes which are suitable for the production of the elastomer fibers in accordance with this invention are preferably those which are extrudable and are prepared from an aromatic diisocyanate, for instance, 4,4'-diphenyl methane diisocyanate (MDI) and the linear polyether, for example, polytetramethylene glycol or an aliphatic polyester such as polybutylene adipate or polycaprolactondiol. Block polymers of a cycloaliphatic diisocyanate such as hexahydro-MDI and a linear segmented polyether, which are known to be particularly useful for medical purposes, are also suitable. The softening point of the suitable polyurethane lies between 180° to 230° C., the hardness is 80° to 95° Shore A, and the density is 1.1 to 1.25 g/cm$^3$. This hardness plays an important role for the tackiness of the polyurethane thread.

Related polyurethanes such as the polyether- or polyetherester- or polyester amine- urethanes, provided they exhibit a sufficient melt stability, may also be used and melt-spun as well as processed into elastic threads.

In accordance with the process of the present invention, we have succeeded in surprising fashion to produce melt-spun, spool-windable, multifilament elastomeric threads with a high initial module whose individual fibrills are not stuck together. The process is an integrated, one-step procedure, that is, immediately after spinning of the threads they are wound on spools in stretched condition with the aid of known devices, without requiring a further process step such as relaxing, for example.

The resulting smooth, elastic thread is suitable for further processing immediately after being wound on the spool. Compared to known elastomers, the thread has the advantage that it can be used as such without having to be covered.

A preferred manner of carrying out the process is by first melting the polyurethane granulate at 190° to 240° C. and extruding it. The spool-winding speed should be at least 600 m/min, preferably more than 900 m/min, and the stretch ratio should be at least 1.5. Since stretching and spool-winding takes place immediately after doffing of the spun thread, the procedure can be characterized practically as simultaneous, concurrent or spin-stretching.

On a first pair of rollers the thread is not yet completely cooled, which still permits an actual stretching in the stretch zone. This stretching and therefore also the greater molecular orientation in the thread shows itself also by a lower breaking elongation and a higher boiling shrinkage and especially a strongly elevated module. The orientation of the molecule in the dolling zone depends, as expected, upon the dolling speed and, based upon the strongly temperature-dependent viscosity of the polymers, also to a high degree upon the spinning temperature. If the preliminary orientation is too small, the module can no longer be increased to the maximum values.

Spool-winding preferably takes place without tension.

This high-module, spin-stretched thread may satisfactorily be processed into a flat product. In order to avoid strong dimension losses of the flat product in the finishing treatment, it is advantageous to fix the same prior to the finishing treatment. The selection of the fixation condition make it possible to control the resulting elasticity of the product. Based upon the inherent shrinkage, the thread produced according to the invention is also especially suitable for shape fixation.

The flat product can, however, also be tempered in water at a maximum of 130° C., but preferably at temperatures below the boiling point of water, for instance at 94° to 100° C.

It is also advantageous to temper the stretched elastomer thread prior to processing in order to impart the desired elasticity to it.

Tempering is preferably effected by means of steam, hot water or heated metal surfaces. In order to guarantee a sufficient dimension stability, the tempering should take place at temperatures of less than 90° C.

Prior to tempering, the elastomer thread exhibits a module of at least 10, preferably more than 20, especially 20 to 40 cN/tex, a breaking elongation of 80 to 300%, preferably 90 to 200%, based on length of the unelongated thread. The stretched elastomer thread exhibits a completely reversible elasticity up to the breaking elongation.

After tempering, the rubber-elastic elastomer thread according to the present invention has, depending upon the treatment type and temperature, a tear elongation of 100 to 800%, especially 300 to 600%, and preferably about 400%, based upon the length of the unelongated thread (see Tables 1 and 2).

The spin-stretched elastomer thread is virtually completely reversibly elastic up to the tear limit.

Preferred areas of utility of the rubber-elastic elastomer thread according to the invention are flat textile products. It has been found to be advantageous to process the elastomer thread according to the invention, together with at least one other non-elastic thread made of synthetic natural fibers, into an elastic flat product.

The invention shall be further illustrated with the aid of drawings and examples.

BRIEF DESCRIPTION OF THE DRAWINGS

In FIG. 1 the reference 1 designates a spinning block with spinning nozzles. A bundle of fibrills 2 is combined on a pin or roller 3 to form a thread 2' which is passed over a gallette 4 and a separating roller 4' which together form the roller pair 4, 4'. Another pair of rollers 5, 5' consists of a galette 5 and a separating roller 5'. 6 designates a spool with a drive roller 7.

In FIG. 2 the curve 1 shows a cold spin-stretched thread. Curves 2 to 4 show force-elongation of the same thread which has been tempered at various temperatures; curve 2 at 40° C., curve 3 at 60° C. and curve 4 at 98° C. in water.

FIG. 3 shows the hysteresis curve 1 of the spin-stretched thread, and hysteresis curve 2 of the spin-stretched thread which has additionally been treated at 98° C. in water.

Figure 1:
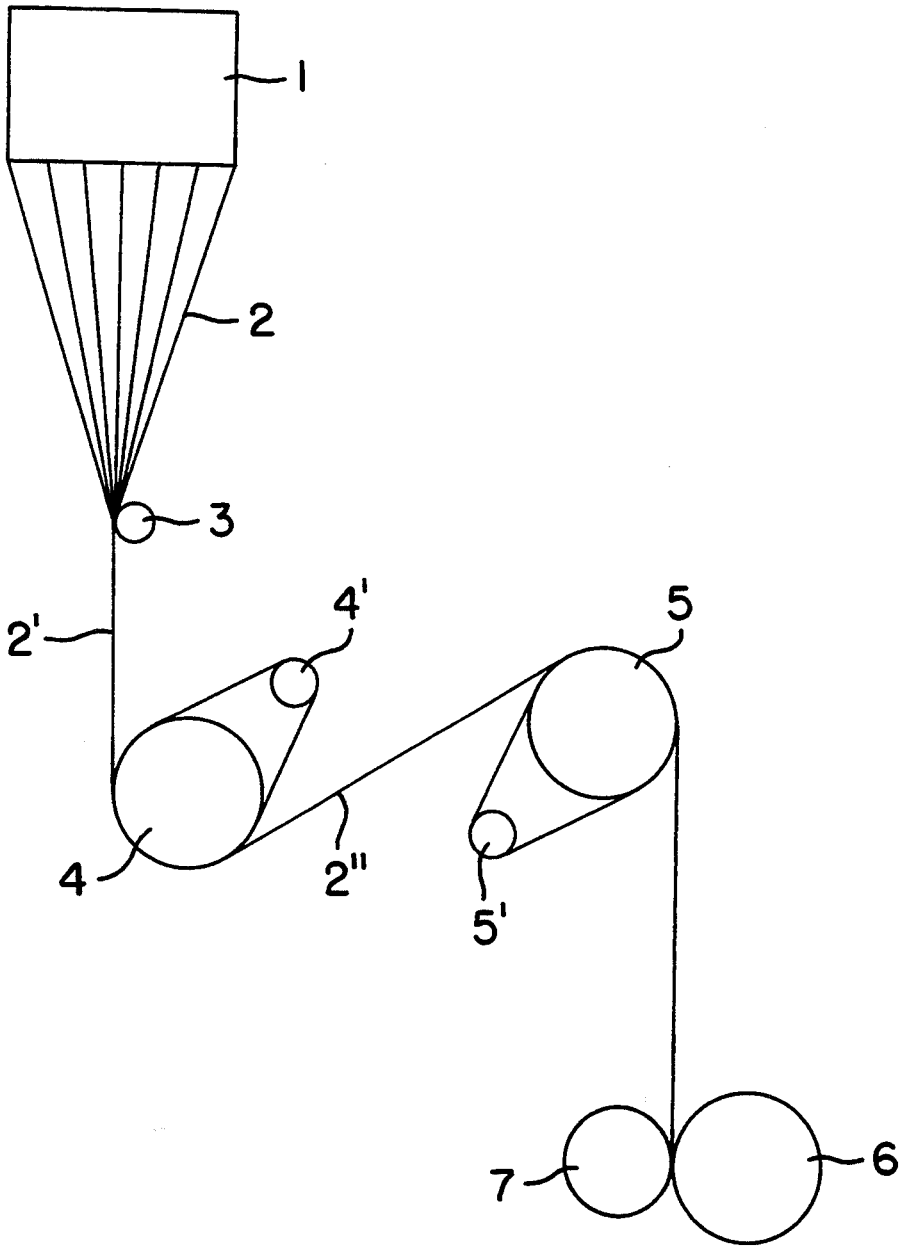
FIG. 1 shows a schematic flow sheet of the spin-stretch process.
Figure 2:
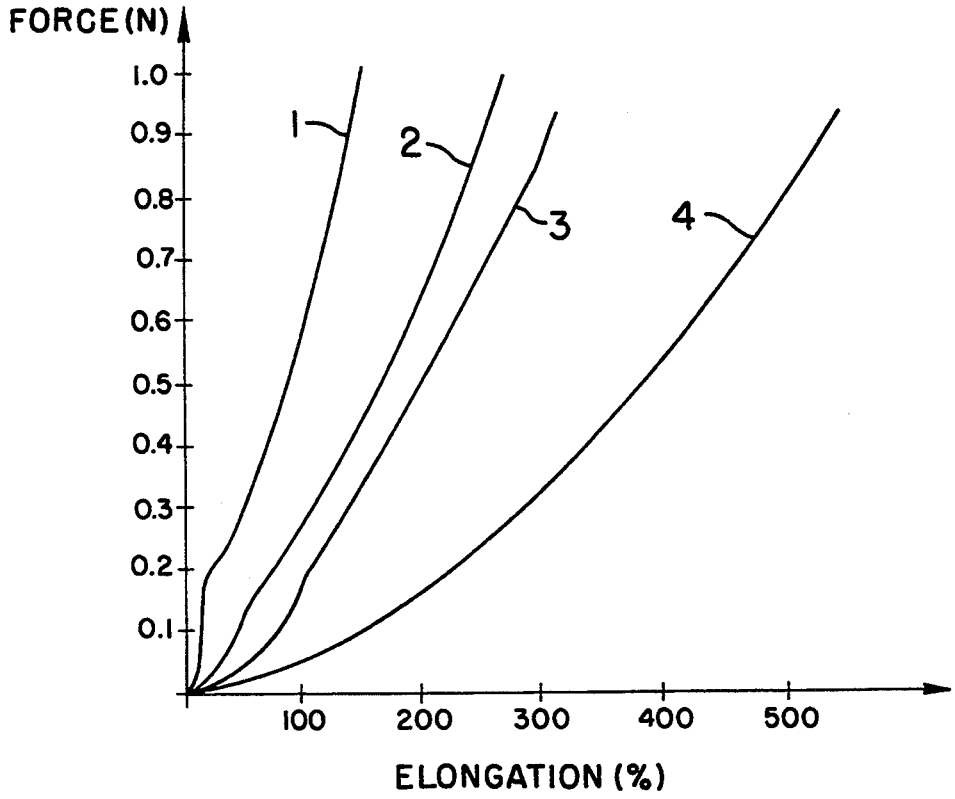
FIG. 2 shows force-elongation diagrams
Figure 3:
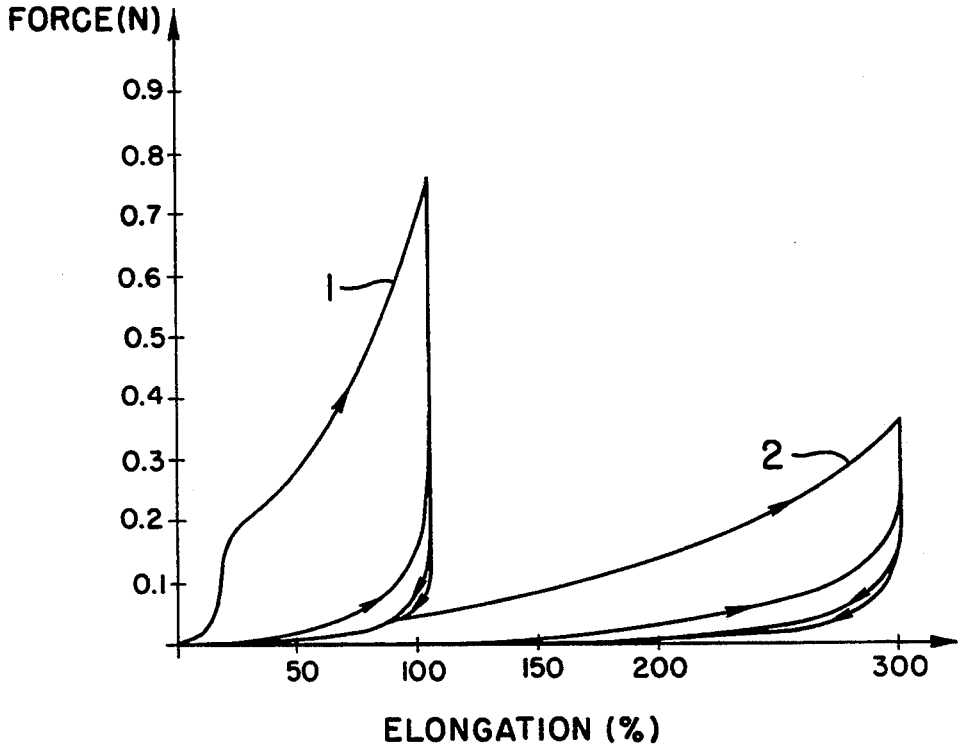
FIG. 3 shows hysteresis curves

As can been seen from the difference of the curves before and after the thermal treatment, the result is a higher elasticity at approximately the same tear force.

Two working examples shall further illustrate the invention.

Example 1

10 kg of a ESTANE® 54351, a thermoplastic polyurethane of Goodrich, prepared from an aromatic diisocyanate, a polycaprolactone macrodiol and butanediol with a hardness of 84° shore A, a softening point of 185° C., a density of 1.15 g/cm$^3$, were first dried at 60° C. for 8 hours and at about 50 millibar, then at 90° C. for 24 hours and in a high vacuum until a residual moisture content of 0.01%, whereby a threshold viscosity of 1.80, measured in a solvent mixture of 1:1 phenol/tetrachloroethane with a Ubbelohde-viscosimeter at 25° C. and a concentration of 0.4%, resulted.

For improvement of the light fastness, TINUVIN type UV-absorbers marketed by of Ciba Geigy may be polymerized into the polyurethane or may be spread on the granulate as a powder. For improvement of the elastic properties and the sheen, fillers such as $TiO_2$ or $SiO_2$, may be employed.

For the preparation of the thread the granulate is melted under exclusion of oxygen in an extruder at, for example, 210° C., pressed through a 10 μm filter screen and through the spin block 1 with a spinning nozzle with eight holes at a pressure of 60 bar, and spun in a spin-stretch process into a multifilament dtex 41 f 8. For this purpose the individual filaments 2 are cooled in a blow shaft, which is not shown, with air at a pressure of 40 mm water, and collected by means of pin 3 and oiled. The spinning velocity, predicated by the rotation of galette 4, is 600 m/min. After 5 loopings on the roller pair 4, 4' the thread 2' is passed to the second roller pair 5, 5' with 5 loopings, and is cold-stretched 2.1 times. The cold rollers 4 and 5 with a smooth surface are driven with electric motors which are not shown, and the counter-rollers 4' and 5' are driven with air. In this way the friction or thread tension remains so low that thread 2' is not distorted. By means of a driven roller 7 the thread 2''' is wound on a spool at a spool-winding velocity of 1250 m/min without tension.

The manufacture of the thread takes place in accordance with FIG. 1 pursuant to the spin-stretch process.

Example 2

10 kg of ESTANE ® 58277, a thermoplastic polyurethane, also on polyester basis of Goodrich, which is suitable for medical uses, with a hardness of 93° Shore A, a softening point of 185° C. and a density of 1.19 g/cm$^3$ was spun and simultaneously stretched in analogy to Example 1.

In the following Tables 1 and 2 the thread properties of Examples 1 and 2 are summarized.

TABLE 1

| | | | | | | |
|---|---|---|---|---|---|---|
| Polymer | | Estane ® 54351 | | | | |
| Type | | MDI/polycaprolactonediol | | | | |
| Degree of stretching | | 2.1 | | | | |
| Titer (before treatment) | dtex | 41 f 8 | | | | |
| Treatment temperature ($H_2O$/2 min) | °C. | none | 30 | 40 | 60 | 98 |
| Shrinkage at treatment temperature | % | — | 6 | 17 | 33 | 61 |
| Module* | cN/tex | 14.6 | 9.2 | 5.8 | 2.3 | 0.5 |
| Boiling shrinkage | % | 61 | — | — | — | — |
| Titer (after treatment) | dtex | — | 43 | 49 | 61 | 105 |
| Breaking elongation | % | 145 | 155 | 190 | 270 | 490 |
| Breaking force | N | 1.02 | 0.95 | 0.88 | 0.91 | 0.95 |
| Strength | cN/tex | 25 | 22 | 18 | 15 | 9 |
| Hysteresis (5 cycles) | % | 130 | 150 | 150 | 180 | 300 |
| Residual elongation | % | 0 | 0 | 0 | 0 | 20 |

*Module is understood to mean the force at 100% elongation based on the starting titer The thread 2" according to the invention exhibits the properties shown in the table, first column. Its strength is 25cN/tex, its breaking elongation is 145% and the boiling shrinkage is 61% based on the length of the unelongated thread.

TABLE 2

| | | | | | | |
|---|---|---|---|---|---|---|
| Polymer | | Estane ® 58277 | | | | |
| Type | | MDI/aliphatic polyester | | | | |
| Degree of stretching | | 2.1 | | | | |
| Titer (before treatment) | dtex | 54 f 8 | | | | |
| Treatment temperature ($H_2O$/2 min) | °C. | none | 30 | 40 | 60 | 98 |
| Shrinkage at treatment temperature | % | — | 13 | 20 | 36 | 64 |
| Module* | cN/tex | 23.3 | 18.2 | 11.9 | 3.1 | 0.9 |
| Boiling shrinkage | % | 64 | — | — | — | — |
| Titer (after treatment) | dtex | — | 62 | 67 | 84 | 150 |
| Breaking elongation | % | 95[1)] | 110 | 165 | 230 | 450 |
| Breaking force | N | 1.36 | 1.27 | 1.47 | 1.42 | 1.34 |
| Strength | cN/tex | 25 | 21 | 22 | 17 | 9 |
| Hysteresis | % | 80 | 80 | 130 | 200 | 300 |
| Residual elongation | % | 0 | 0 | 0 | 42 | 70 |

*Module is understood to mean the force at 100% elongation based on the starting titer
[1)]Module calculated on 100%

1) Module Calculated on 100%

The thread can also be easily wound on a spool. It exhibits no tendency toward tackiness. A microscopic cross-sectional photograph shows that the individual filaments are distinctly separated from each other and exhibit the desired round cross section.

This thread, when it is subjected to a heat treatment, for example for 2 minutes in hot water, exhibits the properties shown in columns 2–5 of the table. The breaking elongation in boiling water (column 5) increases to 490%. The elastic properties are comparable with those of glued together, multifilament, wet-spun polyurethane fibers which are commercially available.

Examples 3 and 4

10 kg of the thermoplastic polyurethane of Example 1 were spin-stretched in accordance with our spin-stretching process at a take-off rate of 600 m or 1600 m/min at various spinning temperatures.

| | | | |
|---|---|---|---|
| Example | | 3 | 4 |
| Polymer | | Estane 54351 | |
| Spinning temperature | °C. | 200 | 240 |
| Take-off | | 600 | 1600 |
| Degree of stretching | | 1.6 | 2.0 |
| Relaxation | % | | |
| Spool winding speed | m/min | 960 | 3200 |
| Titer | | 53 f 14 | 20 f 14 |
| Module | cN/tex | 21 | 20 |
| Boiling shrinkage | % | 60 | 55 |
| Tear elongation | % | 155 | 160 |
| Strength | cN/tex | 25 | 26 |

As these Examples show, the possible spinning speed depends strongly upon the polymer viscosity and thus on the spinning temperature. At the higher temperature of Example 4, the take-off speed and thus the economy of the thread production can be strongly increased.

The spun-stretched original thread can, for example, be knitted together with a polyamide dtex 33 f 10 into a flat product. After fixation or after a heat treatment, such as dying, of this knitted product it can be further processed in known manner into a rubber-elastic flat product.

Special areas of application are medical support hose, elastic ribbons, sport apparel, swimming trunks, panty hose (fine titer), elastic filters, elastic articles for the apparel industry as well as for the production of elastic articles for medical or surgical purposes, especially for prostheses.

Designations

1 Spin block
2 Bundle of fibrills
2' Thread unstretched
2" Thread stretched
3 Pin
4 Galette
4' Separating roll
5 Galette
5' Separating roll
6 Spool
7 Drive shaft for spool 6

We claim:

1. The process for the manufacture of a smooth, non-tacky multifilament elastomer thread, which comprises melt-spinning thermoplastically deformable polyurethane having a hardness of 80° to 95° Shore to form an elastomer thread, cooling the elastomer thread, irreversibly stretching the cooled elastomer thread, and, immediately after stretching, spooling the stretched thread at a rate of at least 600 m/min.

* * * * *